United States Patent [19]

Childs

[11] 4,295,860

[45] Oct. 20, 1981

[54] MULTIFUNCTIONAL GASOLINE ADDITIVES

[75] Inventor: Michael E. Childs, Wilmette, Ill.

[73] Assignee: UOP Inc., Des Plaines, Ill.

[21] Appl. No.: 161,828

[22] Filed: Jun. 23, 1980

[51] Int. Cl.[3] ..... C10L 1/18; C10L 1/22

[52] U.S. Cl. ..... 44/63; 44/66; 44/72; 44/77; 44/DIG. 1; 252/390; 252/392; 44/73

[58] Field of Search ..... 44/71, 72, 66, 77, DIG. 1, 44/63, 73; 252/390, 392

[56] References Cited

U.S. PATENT DOCUMENTS 2,996,365 8/1961 DeGroote et al. ..... 44/66

3,294,499 12/1966 Brook et al. ..... 44/77

4,134,846 1/1979 Machleder et al. ..... 44/75

*Primary Examiner*—Jacqueline V. Howard

*Attorney, Agent, or Firm*—James R. Hoatson, Jr.; Raymond H. Nelson; William H. Page, II

[57] ABSTRACT

The reaction products of glycidyl ethers, wherein the alkoxy portion contains from about 6 to about 20 carbon atoms, with alkylenediamines, N-alkyl alkylenediamines, and N-alkoxyalkyl alkylenediamines are effective carburetor detergents and reducedeposits on various components of internal combustion engines. An example is the reaction product of the glycidyl ether whose alkoxy group is a mixture of 12–14 carbon atom chains with N-tallow-1,3-propylenediamine.

3 Claims, No Drawings

MULTIFUNCTIONAL GASOLINE ADDITIVES

BACKGROUND OF THE INVENTION

In the normal course of use, deposits form on many parts of an internal combustion engine and components. Deposits which form on various parts of a carburetor are particularly vexing, leading to a decrease in overall efficiency of combustion attended by increasing gas consumption and undesirable exhaust gas emissions. Deposits also tend to accumulate on other parts of the fuel induction system, such as valves and ports, with similar adverse effects.

An object of this invention is to provide additives which when added to fuel oils, especially gasoline, in minor amounts act as an effective carburetor detergent. Another object of this invention is to provide additives which when added to fuel oils, especially gasolines, in minor amounts materially reduce deposits accumulating on valves and ports of internal combustion engines. Such materials may have additional desirable properties when added to gasoline and used in internal combustion engines. For example, materials of this invention may inhibit gum formation, may act as anti-stalling or carburetor de-icing agents, as corrosion inhibitors, and so forth. Still another object is to provide additives effective as carburetor detergents at concentrations less than about 100 parts per million. Materials in the prior art generally are required to be used at a concentration over about 100 parts per million, as exemplified in U.S. Pat. No. 4,134,846.

SUMMARY OF THE INVENTION

Therefore it is an object of this invention to provide materials with desirable carburetor detergency properties at concentrations less than about 100 parts per million when added to fuel oils, especially gasoline. An embodiment of this invention is the reaction product of glycidyl ethers with diamines. In a more specific embodiment the glycidyl ether contains from about 6 to about 20 carbon atoms. In another embodiment the amine is ethylene diamine. In yet another embodiment the amine is an N-alkyl or N-alkoxyalkyl propylene diamine. Yet another embodiment is the reaction product of glycidyl ethers with polyamines.

DESCRIPTION OF THE INVENTION

The materials of this invention are the reaction products of glycidyl ethers with polyamines. By glycidyl ethers are meant compounds of the structure

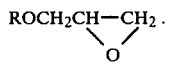

The term polyamines denotes amines having at least two amino groups and at least one unsubstituted or primary amino group, as $NH_2$. The products of this invention result largely from the reaction of an unsubstituted amino group with the methylene group of the epoxide to form a beta-amino alcohol whose general structure may be denoted as $ROCH_2CHOHCH_2NHA$, where A is the organic residue of the amine utilized. However, it is to be understood that where the polyamines of this invention contain a monosubstituted, or secondary, amino group, some fraction of the products of this invention also result from reaction of the latter amino group with the methylene group of the epoxide.

The group R of the glycidyl ethers is a hydrocarbyl group containing from about 6 to about 20 carbon atoms. The hydrocarbyl group may be straight-chain or branched, and may be saturated or unsaturated, although saturated hydrocarbyl groups are preferred. Examples of hydrocarbyl groups suitable for use in this invention include hexyl, heptyl, octyl, nonyl, decyl, undecyl, dodecyl, tridecyl, tetradecyl, pentadecyl, hexadecyl, heptadecyl, octadecyl, nonadecyl, and eicosyl. An example of a class of branched hydrocarbon radicals particularly suited for use in this invention may be represented by the formula $R_1R_2CHCH_2$—, where $R_1$ and $R_2$ are each a saturated hydrocarbyl radical containing from 1 to 17 carbon atoms, and $R_1$ and $R_2$ in combination contain from about 4 to about 18 carbon atoms. Thus $R_1$ and $R_2$ may be methyl, ethyl, propyl, butyl, pentyl, hexyl, decyl, hexadecyl, heptadecyl, etc.

Amines which are suitable for use in this invention include unsubstituted and N-monosubstituted alkylenediamines and ethylene polyamines. The alkylene group of the alkylenediamines may contain from 2 to about 8 carbon atoms, although alkylene groups containing 2 or 3 carbon atoms are preferred. Linear alkylene groups are more commonly employed than are branched alkylene groups, but the latter may be used, although not necessarily with equivalent results. Examples of linear alkylene groups include ethylene, propylene, butylene, amylene, hexylene, heptylene, and octylene. Examples of branched alkylene groups include isopropylene, sec-butylene, iso-butylene, sec-amylene, iso-amylene, etc. It is to be noted that when unsubstituted alkylenediamines are employed the products are largely of the type $ROCH_2CH(OH)CH_2NH$-alk-$NHCH_2CH(OH)CH_2OR$, where alk designates the alkylene group.

The N-alkyl alkylenediamines of this invention are represented by the formula $R_3NH$-alk-$NH_2$, where alk designates the alkylene groups described above. In this branch of the invention a propylene group is a preferred alkylene group. In one aspect of this branch, $R_3$ is an alkyl group containing from about 6 to about 22 carbon atoms which may be either saturated or unsaturated. Such hydrocarbyl groups often are derived from natural fats and oils, such as soybean oil, cottonseed oil, lard, tallow, coconut oil, and palm, sunflower and safflower oils, as examples. Specific examples of suitable hydrocarbyl groups include hexyl, heptyl, octyl, nonyl, decyl, undecyl, dodecyl, tridecyl, tetradecyl, pentadecyl, hexadecyl, heptadecyl, nonadecyl, eicosyl, heneicosyl, docosyl, oleyl, linoleyl, and linolenyl. Since such groups commonly have their commercial origin in fatty acids, they are often supplied as mixtures. Therefore it is to be understood that amines containing a combination of the aforementioned groups are explicitly within the scope of this invention.

In another aspect of this branch of the invention, $R_3$ may be an alkoxyalkyl moiety. The alkyl portion is an alkylene group conforming to the description given above, although the embodiment where the alkylene group is a propylene group is preferred. The alkoxy group contains from about 1 to about 25 carbon atoms, but preferably from about 6 to about 20 carbon atoms. Suitable groups representative of the carbonaceous portion of the alkoxy group include methyl, ethyl, propyl, butyl, pentyl, hexyl, heptyl, octyl, nonyl, decyl, eicosyl, pentacosyl, etc. Such groups commonly have their commercial origin in fatty acids and petroleum-derived alcohols, and consequently are often supplied as mixtures. Therefore it is to be understood that amines containing a combination of the aforementioned group are explicitly within the scope of this invention.

When the carbonaceous portion of the alkoxy group is derived from fatty acids the major portion is an unbranched aliphatic group. When the carbonaceous portion comes from petroleum-derived alcohols the major portion generally is a branched aliphatic group. In each case minor amounts of unsaturated material may be present. Therefore it is to be understood explicitly that the carbonaceous portion of the alkoxy group of the alkoxyalkylamines of this invention may be comprised of either a major portion of unbranched or branched aliphatic groups which may contain minor amounts of unsaturation.

Other polyamines which may be used in this invention have the formula $H_2N(CH_2CH_2NH)_xH$, where x is an integer from 2 to about 8. Examples of such polyamines include diethylenetriamine, triethylenetetraamine, tetraethylenepentamine, pentaethylenehexamine, etc. Polyamines where x is 2 or 3 are preferred materials, that is, diethylenetriamine and triethylenetetraamine are preferred in this branch of the invention.

The materials described herein may be advantageously employed as a detergent in a broad variety of fuel oil, for example, diesel oil, aviation oil, gasoline, burner oil, etc., although their use in gasoline is particularly advantageous. Such materials when used as additives exhibit detergent properties at concentrations at least as low as 25 parts per million, although some may be useful at concentrations as low as 10 parts per million. It has been found that gasoline containing from about 15 to about 100 parts per million of additives of this invention has advantages in preventing deposits on working parts of carburetors and on the valves and ports of internal combustion engines. It is to be understood that concentrations greater than about 100 parts per million may be used, although economic considerations dictate their usage at the lowest effective level. Such compositions also may contain other additives, for example antioxidants, so as to provide a gasoline with a complete spectrum of functional additives.

The additives of this invention may be conveniently prepared by heating the glycidyl ether with an equivalent amount of amine, based on primary amino groups. Thus, if 1 molar proportion of the glycidyl ether is used, an equivalent amount of an amine containing but one primary amino group is 1 molar proportion; an equivalent amount of an amine containing two primary amino groups is $\frac{1}{2}$ molar proportion; an equivalent amount of an amine containing three amino groups is $\frac{1}{3}$ molar proportion, and so forth. Reaction temperatures from about 100° C. to about 200° C. and higher may be used, although the lower range of temperatures is advantageous in minimizing charring, color body development, etc. Frequently, it is advantageous to use a solvent to moderate the reaction and to promote ease of handling. The nature of such solvents is not critical, so long as they are unreactive to both reactants and products. Aromatic solvents, especially those whose boiling point is in the aforementioned range, are a commonly used class of solvents, and include materials such as toluene, ethylbenzene, the xylenes, and so forth. When such solvents are used the reaction often is conducted at the temperature of reflux. Generally the reaction is complete in 3 to 10 hours.

Solvents commonly are employed in an amount so as to afford solutions containing about 50% by weight of reaction product, used per se as additives. However, the solvent may be removed by suitable means, as by distillation, if desired and the high-boiling material may be used in toto as the additives of this invention. Further purification of the high-boiling material also may be effected, although generally this provides no substantial advantage.

It also has been observed that the desired reaction is substantially promoted by the addition of phenols in amounts ranging from about 1 to about 25 mole percent based on glycidyl ether. Such use of phenols may reduce reaction time by a factor as great as twelve.

The examples given below serve only to illustrate this invention, and are not intended to limit this invention in any way.

EXAMPLE I

A solution of a glycidyl ether where the alkoxy group was derived from fatty acids containing mainly 12–14 carbon atoms (60 g, 0.2 mole) and ethylenediamine (6 g, 0.1 mole) in 70 g mixed xylenes was heated at a temperature in the range from about 125° C. to about 135° C. until reaction was complete. The reaction was monitored by following the disappearance of glycidyl ether using gas-liquid partition chromatography (glpc) and generally was complete in 4–8 hours. The infra-red spectrum of the resulting product showed the presence of a hydroxyl, whereas the nmr spectrum showed the absence of absorption at 3.0 δ characteristic of the glycidyl ether.

EXAMPLE II

A suspension of N-tallow-1,3-propylenediamine (33 g, 0.1 mole), the glycidyl ether of Example I (30 g, 0.1 mole) and 63 g mixed xylenes were heated at a temperature in the range from about 125° C. to about 135° C. until glpc examination showed the absence of glycidyl ether, generally complete in about 6 hours.

EXAMPLE III

The experimental procedure was analogous to that described in Example I, using a glycidyl ether of formula

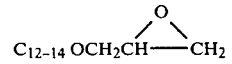

(25 g, 0.1 mole), an alkoxypropyl-1,3-propylenediamine where the alkoxy group was comprised of chains containing 12–15 carbon atoms (35 g, 0.1 mole) and 60 g xylene. The mixture was heated at a temperature range from about 125° C. to 135° C. until glpc showed the disappearance of glycidyl ether.

EXAMPLE IV

To show the effect of phenol in reducing reaction times, two experiments were conducted. In both the glycidyl ether was that described in Example I (11.6 g, 0.039 mole) and the amine was 1,3-propylenediamine (1.5 g, 0.02 mole) in 13 g mixed xylenes. The reaction temperature was maintained at 100° C., and the disappearance of the glycidyl ether was followed by glpc. To one reaction mixture was added 1 g phenol; to the other reaction mixture no phenol was added. The time for complete disappearance of ether in the absence of phenol was 3 hours; the time for complete disappearance of ether in the presence of phenol was less than 15 minutes.

This experiment shows that phenols can reduce reaction times by a factor of more than 12. Acceleration also was observed upon addition of t-butyl hydroxyanisole, nonylphenol, and a mixture of various mono- and di-t-butylphenols.

EXAMPLE V

The effectiveness of additives as carburetor detergents and in reducing valve deposits was measured as follows. A bench-mounted engine was run for 5 hours on 4-minute cycles, each cycle being 1 minute at 1500 rpm and 3 minutes at idle, or about 550 rpm. At the end of this time the top and bottom of the carburetor plate was visually examined and given a rating from 0 (dirty) to 100 (clean). The total deposit on the intake valve was weighed in mg and is reported as TOT in the table. The deposit remaining on the valve after the rim is scraped off is labeled RIM. The entry 600 is the sum of the visual ratings, each being 0 (dirty) to 100 (clean), for the cylinder wall, piston head, cylinder head, combustion chamber pick-up, intake valve seat, and exhaust port. Finally, the entry No. 4 is the visual rating, on the same 0–100 scale, for the intake valve insert. Results for several additives at a concentration of 25 ppm are tabulated below.

TABLE I

| Amine | Evaluation of Additives<br>Glycidyl Ether | C.D | TOT | RIM | 600 | No. 4 |
|---|---|---|---|---|---|---|
| Ethylenediamine | $C_{12-14}H_{25-29}OCH_2-CH(O)CH_2$ | 95/95 | 86.2 | 63.8 | 260 | 90 |
| Diethylenetriamine | $C_{12-14}H_{25-29}OCH_2-CH(O)CH_2$ | 95/99 | 62.4 | 53.4 | 240 | 80 |
| N-tallow-1,3-propylenediamine | $C_{8-10}H_{17-21}OCH_2CH(O)CH_2$ | 95/90 | 67.3 | 23.8 | 310 | 70 |
| $C_{13}H_{27}O(CH_2)_3NH(CH_2)_3NH_2$ | $C_{12-14}H_{25-29}OCH_2CH(O)CH_2$ | 75/75 | 70.5 | 44.9 | 390 | 80 |
| Product A | | 90/90 | 59.5 | 47.4 | 300 | 40 |
| Blank | | 0/0 | 51.8 | 28.5 | 260 | 55 |

In this Table, Product A refers to material in current commercial use as a carburetor detergent. Blank refers to gasoline without additives. The effects of the additives of this invention generally are quite beneficial, and are superior to the current commercial product in several aspects.

What is claimed is:

1. A composition comprising a major amount of a fuel oil and an additive consisting of from about 10 ppm up to 100 ppm of the reaction product of:

(a) a glycidyl ether presented by the formula:

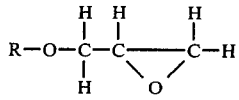

wherein R is either (i) a saturated hydrocarbyl group possessing from about 6 to about 20 carbon atoms or

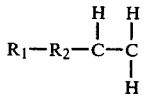

(ii)

wherein $R_1$ and $R_2$ are saturated hydrocarbyl radicals containing from 1 to 17 carbon atoms and wherein the sum of $R_1$ and $R_2$ is from about 4 to about 18 carbon atoms with (b) an N-monosubstituted alkylenediamine having from 2 to about 8 carbon atoms in the alkylene moiety.

2. The composition of claim 1 wherein the fuel oil is gasoline.

3. The composition of claim 1 wherein the alkylenediamine is selected from the group consisting of ethylenediamine and propylenediamine.

* * * * *